US005915657A

United States Patent [19]

Ptak

[11] Patent Number: 5,915,657

[45] Date of Patent: Jun. 29, 1999

[54] MONITOR SUPPORT MECHANISM

[75] Inventor: Keith R Ptak, Jamestown, N.Y.

[73] Assignee: Weber Knapp Company, Jamestown, N.Y.

[21] Appl. No.: 09/027,447

[22] Filed: Feb. 20, 1998

[51] Int. Cl.[6] ..... E04G 3/00

[52] U.S. Cl. ..... 248/286.1; 108/138; 248/918

[58] Field of Search ..... 248/284.1, 286.1, 248/918; 108/137, 138, 145, 149

[56] References Cited

U.S. PATENT DOCUMENTS

| | | | |
|---|---|---|---|
| 4,691,888 | 9/1987 | Cotterill | 248/284.1 |
| 5,249,533 | 10/1993 | Moore, III | 108/138 |
| 5,503,086 | 4/1996 | Hoffman et al. | 108/138 |
| 5,549,052 | 8/1996 | Hoffman | 108/138 |
| 5,791,263 | 8/1998 | Watt et al. | 108/138 |

*Primary Examiner*—Ramon O. Ramirez
*Assistant Examiner*—Robert Lipcsik
*Attorney, Agent, or Firm*—Phillips, Lytle, Hitchcock, Blaine & Huber LLP

[57] ABSTRACT

A monitor support mechanism (20) includes a monitor support (22) having two brackets (23, 23), and a housing (25) secured to the underside of a table (24) adjacent the rear edge (26). A swinging parallelogram-type linkage (29) operatively connects the monitor support with the housing. Springs (33) within the housing bias the linkage to urge the monitor to move upwardly. An adjustment mechanism (35) is arranged to permit adjustment of the compressive displacement of the springs so that the spring force will balance the weight of the monitor. The springs act on the linkage mechanism through low-friction rollers (40).

10 Claims, 1 Drawing Sheet

MONITOR SUPPORT MECHANISM

FIELD OF THE INVENTION

The present invention relates generally to devices for adjustably supporting an object, such as a computer monitor, and, more particularly, to an improved out-of-the-way under-the-table mechanism for supporting a monitor in any of a number of positions relative to a table or work surface.

BACKGROUND ART

With the advent of the personal computer around 1980, various pieces of furniture have been developed to accommodate the presence a central processing unit (CPU), a monitor and a keyboard relative to a table or work surface. Some of these devices include under-the-table devices for concealing a keyboard when not in use. CPU's are now commonly stored under the desk or alongside it, so as to not physically obstruct the work surface. However, monitors should be positioned where they may be most easily viewed. Because different people prefer to position monitors in different positions and spatial orientations, monitors have been developed with omni-directional pivotal mechanisms between the monitor and the base to allow the angular orientation of the monitor screen to be varied relative to the user.

However, in some instances, it would be desirable to selectively raise and lower the monitor to accommodate the preferences of various individuals and users.

Accordingly, it would be generally desirable to provide an under-the-table mechanism for supporting a monitor that allows the vertical position of the monitor to be adjusted relative to a table, desk or other work surface.

DISCLOSURE OF THE INVENTION

With parenthetical reference to the corresponding parts, portions or surfaces of the disclosed embodiment, merely for purposes of illustration and not be way of limitation, the present invention broadly provides an improved mechanism (20) for supporting an object, such as (but not limited to) a computer monitor (21).

In one aspect, the improved mechanism includes a support (22) for the object; a table (24) having a front edge (28) and a rear edge (26); a housing (25) secured to the underside of the table adjacent the rear edge thereof; a linkage (29) having a pair of inner arms (30, 30) and a pair of outer arms (31, 31), each of the arms having an object end (30', 31') and having a housing end (30", 31"), the arms being pivotally connected at the object end to the object support and being pivotally connected at the housing end to the housing to define a movable four-bar mechanism, such as a swinging parallelogram; biasing means (32) arranged within the housing and acting against the linkage to exert a force on the linkage that urges the object support to move upwardly, the biasing means having adjustment means (35) for adjusting the force exerted by the biasing means on the linkage; having transmission means (39) for transferring the force to the linkage; and having at least one spring (33) acting between the adjustment means and the transmission means, such that the object may be supported at various positions above and below the table. In the disclosed embodiment, the transmission means includes low-friction roller means (40) and follower means, such as a plate (34).

In another aspect, the improved mechanism includes a monitor support (22) having two transversely-spaced mounting brackets (23, 23), a table (24) having a front edge (28), and a rear edge (26), a housing (25) secured to the underside of the table adjacent the rear edge thereof, a linkage (29) having a pair of inner arms (30, 30) and a pair of outer arms (31, 31), each of said arms having a monitor end and a housing end, the arms being pivotally connected at the monitor end (30', 31') to the monitor mounting brackets and being pivotally connected at the housing end (30", 31") to the housing to define a swinging parallelogram, biasing means (33) within the housing, the biasing means acting against the linkage to exert a force on the inner arms that urges the monitor support to move upwardly, the biasing means having adjustment means (35) for adjusting the force exerted by the biasing means on the linkage, having follower means (34) for transferring the force to the inner arms, and having at least two springs (33, 33) acting in parallel between the adjustment means and the follower means, and low-friction roller means (40) operatively arranged to reduce friction between the follower means and the inner arms, such that the monitor (21) may be supported at various positions relative to the table.

In a preferred form of the invention, a torsion bar (41) connects the inner arms for resisting torsional moments applied to the monitor support. In this same preferred embodiment, optional side mounting brackets (45) are attached to the housing to facilitate the attachment of the mechanism to the table.

Accordingly, the general object of the invention is to provide an improved mechanism for supporting an object, such as a computer monitor.

Another object is to provide an improved monitor support device that may be attached to the underside of table, and that allows the monitor to be positioned either above or below the work surface of the table.

Still another object is to provide an improved monitor support mechanism that is compact in design, and that attaches to a table in an out-of-the-way position so as to not interfere with the user's normal functional movements.

These and other objects and advantages will become apparent from the foregoing and ongoing written specification, the drawings, and the appended claims.

DESCRIPTION OF THE PREFERRED EMBODIMENTS

Figure 1:
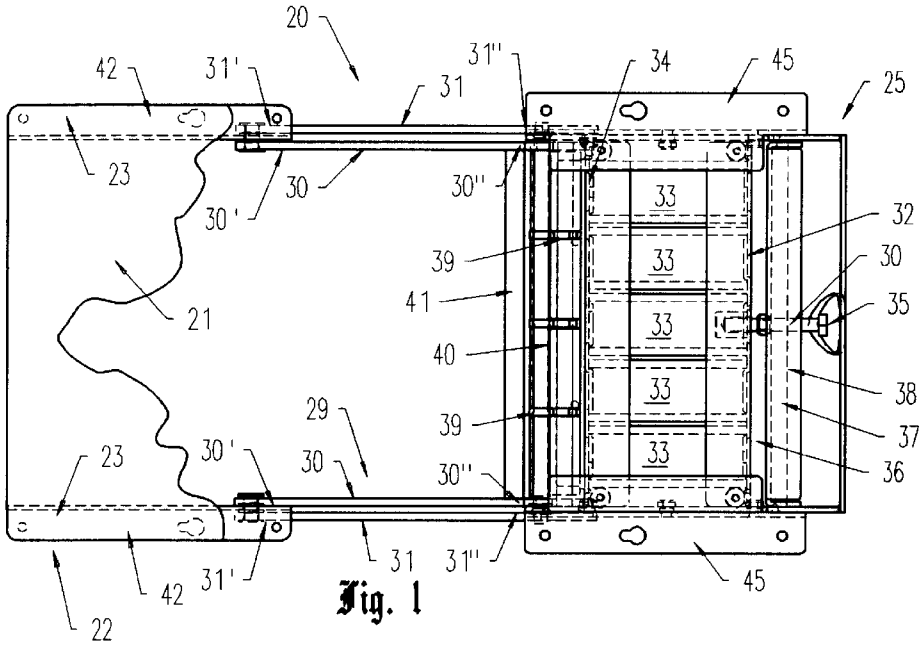
FIG. 1 is a top view of the improved mechanism, this view showing, inter alia, the monitor support brackets, the housing, and the biasing means within the housing.

At the outset, it should be clearly understood that like reference numerals are intended to identify the same structural elements, portions, or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up", and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, the present invention broadly provides an improved mechanism, of which the presently-preferred embodiment is generally indicated at 20, for supporting an object, such as (but not limited to) a computer monitor, of which a fragmentary portion is indicated at 21. The mechanism also includes a monitor support 22 having two transversely-spaced mounting brackets 23, 23, and is adapted to be mounted on the underside of a table, desk or other work surface, of which a fragmentary portion is indicated at 24 in FIGS. 2 and 3. This portion of the table has been omitted from FIG. 1 for clarity of illustration.

Figure 2:
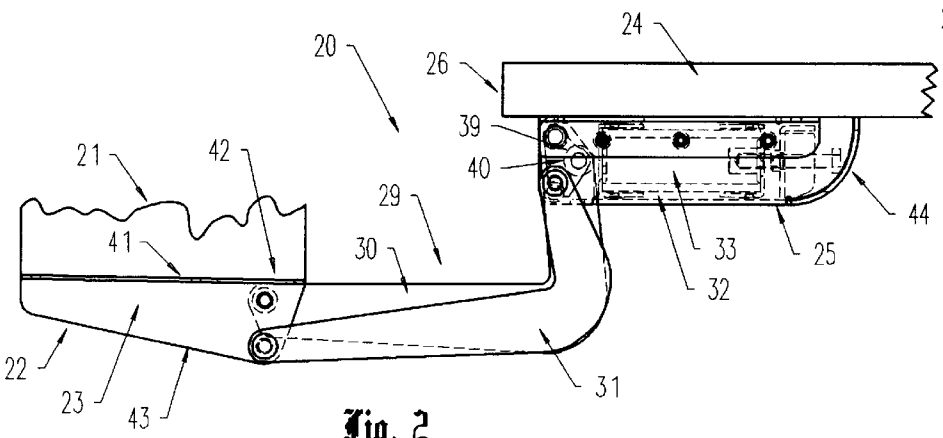
FIG. 2 is a left side elevation of the structure shown in FIG. 1.
Figure 3:
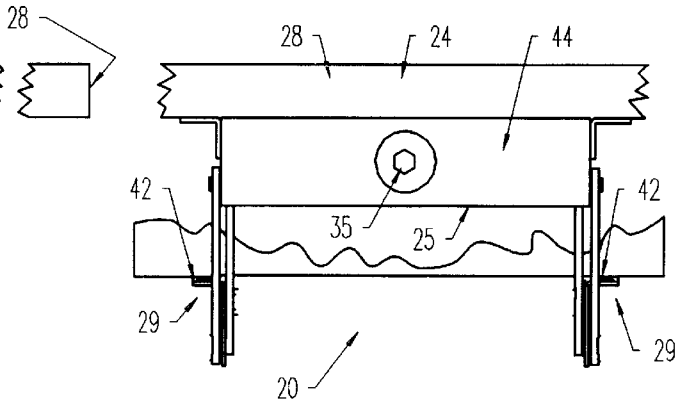
FIG. 3 is a front elevation of the mechanism shown in FIG. 1.

The mechanism further includes a housing, generally indicated at 25, that is adapted to be secured to the underside of the table adjacent its rear edge 26. In FIG. 2, the table is shown as also having a front edge 28.

The mechanism is further shown as including a linkage, generally indicated at 29, having a pair of inner arms 30, 30 and a pair of outer arms 31, 31. Each of these arms is shown as being a generally L-shaped member having a monitor end portion, indicated by the prime of the number of the corresponding arm (i.e., 30', 31'), and having a housing end portion, indicated by the double prime of the corresponding arm number (i.e., 30", 31"). Each marginal end portion of the inner and outer arms is pivotally connected to the associated monitor mounting bracket or housing, as appropriate, to define a movable four-bar mechanism. In the preferred form, this mechanism is a swinging parallelogram such that the upper surface of the mounting brackets will remain in the same spatial orientation (i.e., horizontal) as the parallelogram is pivotally moved through its permissible range of motion. In other words, in FIG. 2, the parallelogram is shown as being in one position such that the monitor is supported below the table surface. When the monitor is elevated to a position above the table (not shown), the arms will rotate about their respective pivotal connections, but the monitor will remain substantially horizontal in the well-known manner.

The mechanism is further shown as including biasing means, generally indicated at 32, contained within the housing. In the preferred form, the biasing means consists of five coil springs, severally indicated at 33, operatively arranged in parallel within the housing to have their right marginal ends bear against an adjustably-positionable support 36 and to have their left marginal ends bear against a plate 34. These springs 33 are in compression, and continuously urge plate 34 to move leftwardly, as seen in FIGS. 1 and 2. An adjustment mechanism, generally indicated at 35, is mounted on the housing. In one form, adjustment mechanism 35 may be a bolt-like member having its shank portion in threaded engagement with a cross-member 37 such that its distal end bears against, and is arranged to displace, bearing plate 36 leftwardly or rightwardly, as desired, to adjust the amount of compressive displacement of the springs.

The invention is further shown as having transmission means, generally indicated at 39, for transferring the force exerted by the biasing means through plate 34 to the inner arms. In the preferred embodiment, a suitable low-friction device, such as a roller 40, is pivotally mounted on the inner arm, and is arranged to be engaged by bearing plate member 34, such that the leftward force exerted by the springs on plate member 34 will be applied to the outer surface of the roller member to bias the inner arms to move clockwise about their pivotal connections with the housing. The effect of this is to urge the monitor to move upwardly. This biasing force is normally opposed by the weight of the monitor. The adjustment mechanism 35 may be appropriately adjusted so that the weight of the monitor will be balanced at any operative position chosen by a user.

In FIG. 2, the monitor is shown as being supported below the table. However, it should be apparent that the mechanism could be articulated in a generally clockwise direction so that the monitor would be supported in positions above the table (not shown), as limited by the kinematic structure of the mechanism.

In the preferred embodiment, a torsion bar 41 operatively connects the housing end portions of the inner arms to resist torsional moments applied to the monitor support brackets.

As best shown in FIGS. 1 and 2, the monitor support brackets are L-shaped members having out-turned horizontal flanges, severally indicated at 42, and upstanding leg portions, severally indicated at 43. These brackets may be formed by appropriately bending suitable sheet material, and are further provided with various holes and openings to accommodate passage of the shank portions of suitable fasteners (not shown) by which the mechanism may be secured to a monitor support or to the monitor itself.

The housing is generally a rectangular box-like structure with various enclosing walls. The front wall 44 is shown as being arcuate for protection of a persons knees that might extend beneath the table.

The mechanism may further include optional side mounting brackets, severally indicated at 45. These devices may be L-shaped members having out-turned flange portions and upstanding leg portions, and may also be provided with suitable holes to accommodate passage of various fasteners (not shown). In the embodiment shown in FIG. 1, the mounting brackets have been attached to the left and right sides of the housing, with the out-turned flanges being exposed and available to mount the entire mechanism to the underside of the table.

Modifications

The present invention contemplated that many changes and modifications may be made. For example, materials of construction are not deemed to be critical. Similarly, matters of size, proportion or degree are generally not deemed to be critical, within the confines of the intended use of a particular part. The invention contemplates that the object or monitor support be operatively connected to the housing by a movable four-bar mechanism. Of these mechanisms, the swinging parallelogram is a well-known special type that affords the feature of keeping the monitor support horizontal at all operative pivotal positions of the linkage. However, it should be clearly understood that other types of four-bar mechanisms may be used instead of a swinging parallelogram. Beyond this, the length and shape of the various inner arms is a matter that is capable of design change and modification. Similarly, the housing might have a curved front wall. However, this is not invariable. If desired, the housing could omit one or more walls, or simply have planar walls. Here again, many changes may be contemplated by a person skilled in the art.

While the preferred embodiment is shown as incorporating five springs in parallel, a greater or lesser number of springs could alternatively be used. These springs need not necessarily be in parallel, but could possibly be in series in an appropriate configuration. Indeed, other types of energy storage devices, such as pressure cylinders and the like, could be substituted for the coil springs shown in the disclosed embodiment. The means for adjusting the compression of these springs may also be readily changed and adjusted. Moreover, the means or mechanism for transmitting the spring force to the inner arms may be changed as well. Indeed, the spring force could be transmitted to other parts of the linkage. While it is presently preferred that a low-friction roller be used between spring plate 34 and the inner arms, other types of devices and mechanisms might alternatively be employed as well. The mechanism need not be directly attached to the table. Alternatively, it could be attached to a supporting frame for the table, or to some other structure, as desired.

Therefore, while a presently preferred form of the invention has been shown and described, and several modifications thereof discussed, persons skilled in this art will readily appreciate that various additional changes and modifications may be made without departing from the spirit of the invention, as defined and differentiated by the following claims.

What is claimed is:

1. A mechanism for supporting an object, comprising:

a support for said object;

a table having a front edge and a rear edge;

a housing secured to the underside of said table adjacent said rear edge;

a linkage having a pair of inner arms and a pair of outer arms, each of said arms having an object end and a housing end;

said arms being pivotally connected at said object end to said support and being pivotally connected at said housing end to said housing to define a movable four-bar mechanism; and biasing means arranged within said housing and acting against said linkage to exert a force on said linkage that urges said support to move upwardly;

said biasing means having an adjustment means for adjusting the force exerted by said biasing means on said linkage, while said linkage remains in a static position relative to said table having transmission means for transferring said force to said linkage, and having a spring acting between said adjustment means and said transmission means such that said object may be supported at various positions above and below said table.

2. The mechanism as set forth in claim 1 and further comprising a torsion bar connecting said inner arms for resisting torsional moments applied to said support.

3. The mechanism as set forth in claim 1 and further comprising side mounting brackets for facilitating attachment of said housing to said table.

4. The mechanism as set forth in claim 1 wherein said four-bar mechanism is a swinging parallelogram.

5. The mechanism as set forth in claim 1 wherein said transmission means comprises follower means and low-friction roller means operatively arranged to reduce friction between said follower means and said linkage.

6. A mechanism for supporting a monitor, comprising:

a monitor support;

a table having a front edge and a rear edge;

a housing secured to the underside of said table adjacent said rear edge;

a linkage having a pair of inner arms and a pair of outer arms, each of said arms having a monitor end and a housing end;

said arms being pivotally connected at said monitor end to said monitor support and being pivotally connected at said housing end to said housing to define a swinging parallelogram; and biasing means arranged within said housing and acting against said linkage to exert a force on said inner arms that urges said support to move upwardly;

said biasing means having arm adjustment means for adjusting the force exerted by said biasing means on said linkage, while said linkage remains in a static position relative to said table having transmission means for transferring said force to said linkage, and having at least one spring acting between said adjustment means and said transmission means such that said monitor may be supported at various positions relative to said table.

7. The mechanism as set forth in claim 6 and further comprising a torsion bar connecting said inner arms for resisting torsional movements applied to said monitor support.

8. The mechanism as set forth in claim 6 and further comprising side mounting brackets for facilitating attachment of said housing to said table.

9. The mechanism as set forth in claim 6 wherein said force is applied to said inner arms.

10. The mechanism as set forth in claim 6 wherein said transmission means includes follower means and low-friction roller means operatively arranged to reduce friction between said follower means and said linkage.

* * * * *